United States Patent [19]

Hadfield

[11] 4,063,514

[45] Dec. 20, 1977

[54] GRENADE FUZE

[75] Inventor: Harry J. Hadfield, Califon, N.J.

[73] Assignee: The United States of America as represented by the Secretary of the Army, Washington, D.C.

[21] Appl. No.: 87,345

[22] Filed: Nov. 5, 1970

[51] Int. Cl.[2] ..... F42B 15/50

[52] U.S. Cl. ..... 102/79; 102/56 SC; 102/68; 102/69; 102/81

[58] Field of Search ..... 102/4, 7.2, 64, 81, 102/56 SC, 68, 69, 79

[56] References Cited

U.S. PATENT DOCUMENTS 2,023,938 12/1935 Savani ..... 102/81

*Primary Examiner*—Verlin R. Pendegrass

*Attorney, Agent, or Firm*—Nathan Edelberg; Robert P. Gibson

[57] ABSTRACT

A fuze for shaped charge grenades adapted to be ejected over a target area from a projectile in flight wherein means are provided in the fuze housing to hold the detonator out of alignment with the firing pin and operable upon ejection of the grenade from the projectile to align the detonator with the firing pin.

4 Claims, 3 Drawing Figures

INVENTOR,
Harry J. Hadfield

BY: Harry M. Saragovitz,
Edward J. Kelly &
Herbert Berl
ATTORNEYS.

GRENADE FUZE

The invention described herein may be manufactured, used, and licensed by or for the Government for governmental purposes without the payment to me of any royalty thereon.

The invention relates to grenade fuzes and more particularly to a fuze for shaped charge grenades which are ejected from a projectile in flight.

One device for dropping a multiplicity of shaped charge grenades over a target area consist of a hollow projectile filled with columns of nested shaped charged grenades. After the projectile attains a predetermined flight distance an ejection charge in the nose of the projectile ejects the grenades over the target area at which time the grenade fuze arms.

Accordingly it is an object of the invention to provide a new and novel fuze for shaped charge grenades which arm at the time of ejection.

Another object of the invention is a fuze for shaped charge grenades wherein the detonator is held out of alignment with the firing pin until such time that the grenade is ejected from the carrying projectile.

A further object of the invention is a new and novel fuze of great reliability and few moving parts for shaped charge grenades which are adapted to be ejected from a projectile in flight.

The specific nature of the invention as well as other objects and advantages thereof will clearly appear from the following description and drawings in which.

Figure 1:
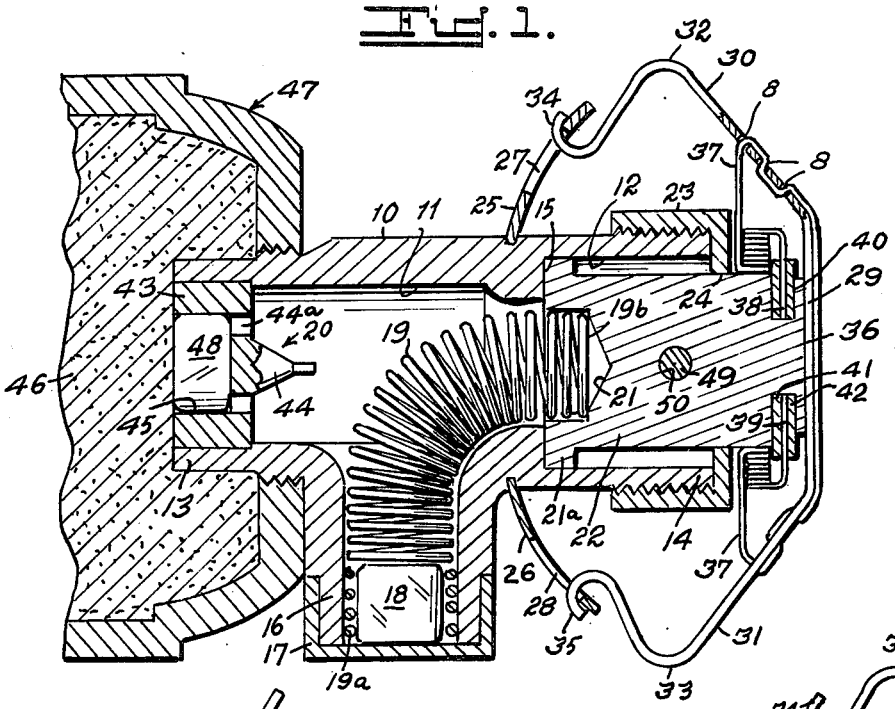
FIG. 1 is a longitudinal cross-sectional view of a preferred embodiment of the invention.
Figure 2:
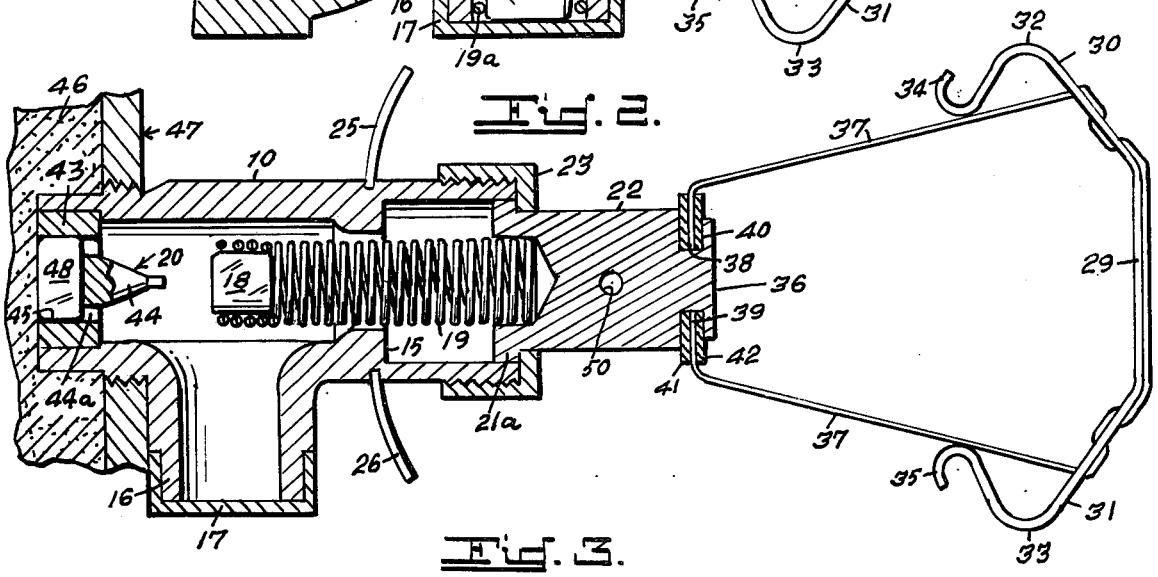
FIG. 2 is a view similar to FIG. 1 illustrating the fuze in armed position.

Referring to the drawings by characters of reference and more particularly to FIG. 1 wherein 10 is the tubular body of the grenade fuze which is provided a longitudinal bore comprising a bore 11 of one diameter extending from one end 13 of body 10 to an intermediate point bore 12 of larger diameter extending from the intermediate point to the opposite end 14 of fuze body 10 whereby an annular abutment 15 is formed at the intermediate point. Intermediate end 13 and abutment 15 housing 10 is provided with a radially extending tubular housing 16 in communication with bore 11 and sealed at its exterior end by means of cap 17. A detonator 18 is releasably fixed in tubular housing 16 adjacent cap 17 whereby out-of-line position in regard to vented firing pin 20 affixed in end 13 of body 10 is obtained. Flexible coil spring or flexible arming shaft 19 has inserted in one end **19*a* by means of threaded engagement or crimping the detonator 18, the opposite end 19*b* being threaded into tapped hole 21 in the flanged end 21*a* of cylindrical weight 22 which is adapted for longitudinal movement in bore 12. The end 14 of body 10 is provided with a closure member 23 formed with a central aperture 24 providing a bearing means for weight 22. The longitudinal movement of weight 22 is limited within bore 12 by means of flanged end 21*a* which when it abutts abutment 15 the fuze is in unarmed condition and when in contact with closure 23** the fuze is in armed condition as shown in FIG. 2.

Two flat steel release clips 25 and 26 provided with slots 27 and 28, respectively, are affixed diametrically opposite each other in the body 10 intermediate its ends and arched towards closure member 23. These clips provide means for releasably retaining the flat spring locking bail 29. The flat spring locking bail 29 is bent back on itself forming inwardly directed or bent arms 30 and 31 having elbows 32 and 33, respectively, which when pressure is radially applied thereto causes disengagement of bail 29 with release clips 25 and 26. The extremities of arms 30 and 31 are formed into hook ends 34 and 35, respectively, which are snapped into slots 27 and 28 to engage respective surfaces of these slots whereby bail 29 is held in releasable engagement with release clips 25 and 26. The bail 29 thus assembled to release clips 25 and 26 engages end 36 of slidable weight 22 whereby weight 22 is releasably urged against abutment 15 through its flange **21*a*. A cloth ribbon 37 is threaded through slots 8 in arms 30 and 31 adjacent the portion of bail 29 in contact with end 36 of slidable weight 22. One end 38 of ribbon 37 and another end 39 are affixed diametrically opposite each other in an annular groove 40 formed in weight 22 adjacent the end 36 thereof. Ribbon ends 38 and 39 may be retained in groove 40 by means of lock washers 41 and 42 or by peening the edges of the groove. A safety feature utilized while the fuze is in storage is provided for by means of extractable pin 49 which is positioned in bore 50 in cylindrical weight 22 and extends therethrough through bores, not shown, in the wall of bore 12 to the exterior thereof whereby movement of weight 22 is restrained. In end 13 of body 10 there is affixed a vented firing pin 20 consisting of a base member 43 including a pin member 44 around which is formed a series of apertures 44*a* in communication with chamber 45 having an open end directed towards the shaped charge 46 of grenade 47 and in which is placed a lead charge or explosive train 48**.

Figure 3:
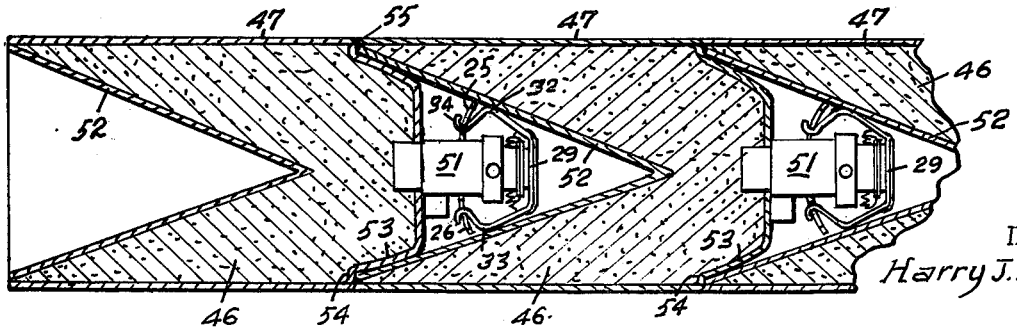
FIG. 3 is a fragmentary cross-sectional view illustrating the grenade nesting arrangement.

In practice, the shaped charge grenades provided with fuzes of the invention are nested in columns in the hollow body of a projectile that is fired from a rifled artillery piece. The projectile has affixed in the nose thereof a time fuze and an ejection charge which when initiated by the time fuze ejects the columns of nested shaped charges through the frangile base thereof. Now with reference to FIG. 3 wherein there is shown but several of the nested shaped charges for the purpose of further illustrating the invention, it can be seen that each of the shaped charge grenades 47 is provided with a shape charge liner or cone 52. The fuze of the invention is generally indicated by reference character 51. Each shaped charge grenade is formed with a tapered head 53 providing a shoulder 54 upon which the bottom 55 of the adjacent shaped charge rests when nested. When these grenades are so nested, the fuze 51 of one grenade is contained within the cavity of liner 52 of the adjacent grenade whereby elbows 32 and 33 of flat spring locking bail 29 are pressed into contact with liner 52 and the bail 29 thereby compressed inwardly whereby the hook ends 34 and 35 disengage the surfaces of slots 27 and 28. When the shaped charge grenades are ejected from the projectile they separate, falling in a spinning motion over the target area with their bottoms pointed down whereupon the hook ends slide through slots 27 and 28 completely releasing the flat spring locking bail 29 from release clips 25 and 26, FIG. 2, whereupon bail 29 caught in the air stream pulls weight 22 rearwardly by means of ribbon 37 into abutment with end closure 23 which causes the flexible coil spring or arming shaft 19 to withdraw detonator 18 from housing 16 and align it with the vented firing pin 20. Upon grenade impact with target, the flexible coil spring 19 containing detonator 18 is driven towards vented firing pin 20 due to the inertia force of weight 22 whereupon detonator 20 impinges or pin member 44 and discharges through perforations 44*a* to initiate the shaped charge 46.

What is claimed is:

1. A fuze for a shaped charge grenade adapted to be ejected over a target area from a projectile in flight comprising in combination:

a body having a longitudinal bore therethrough consisting of a first bore of one diameter extending from one end of the body to an intermediate point thereof and a second bore extending from said intermediate point to the opposite end of the body whereby an abutment is formed in the longitudinal bore at the intermediate point;

a vented firing pin affixed in the first bore at said one end of the body having its pin member directed inwardly of the first bore and having a lead charge affixed in a chamber in the base thereof;

a closure means formed with a central perforation affixed to the opposite end of the body;

a weight member adapted to slide in the second bore having one end extending through said central perforation and an opposite end formed with a flange member normally abutting said abutment and whereby the movement of said weight member is limited between the abutment and closure member;

a capped tubular member formed on said body radially thereof in communication with the first bore;

resilient means coupling a detonator releasably positioned in said tubular member with the flange of said weight member;

spring means releasably coupled to said body and biasing the weight into engagement with said abutment whereby the detonator is releasably retained in out of line position with the vented firing pin; and coupling means coupling said spring means with the said one end of the weight whereby when said fuze assembled to a grenade ejected from said projectile the spring means disengages from said body and is caught in the air stream causing the weight to move in the second bore until its flange contacts said closure means whereupon during such movement the detonator is withdrawn from the tubular member and positioned in alignment with said firing pin by the resilient means.

2. The invention in accordance with claim 1 wherein said resilient means comprises a spiral spring housing said detonator in one end thereof and having its opposite end affixed in a bore in the opposite end of the cylindrical weight.

3. The invention in accordance with claim 1 wherein said coupling means comprises a folded cloth ribbon.

4. The invention in accordance with claim 1 wherein said spring means comprises a releasable flat spring locking bail consisting of a central portion, an inwardly directed arm terminated in a hook extending from one end of the central portion, and an inwardly directed arm terminated in a hook extending from the opposite end of the central portion, said bail assembled to the fuze in a manner that the central portion engages the cylindrical weight and the inwardly directed arms embrace said body with the hook releasably engaged in slots formed in diametrically opposed members affixed to said body.

* * * * *